US005722886A

United States Patent [19]

Steckly

[11] Patent Number: 5,722,886

[45] Date of Patent: Mar. 3, 1998

[54] VENTILATOR

[76] Inventor: Stephen Dale Steckly, 228 Rhatigan Road East, Edmonton, Alberta, Canada, T6R 1N7

[21] Appl. No.: 608,610

[22] Filed: Feb. 29, 1996

[51] Int. Cl.[6] ..... F24F 7/06; F24F 11/053

[52] U.S. Cl. ..... 454/229; 454/228; 236/49.3

[58] Field of Search ..... 454/228, 229, 454/236, 205, 265, 269; 236/49.3

[56] References Cited

U.S. PATENT DOCUMENTS

| | | | |
|---|---|---|---|
| 2,119,935 | 6/1938 | Youker | 454/228 X |
| 2,313,676 | 3/1943 | Shaver | 454/265 |
| 3,307,469 | 3/1967 | Bohanon | 454/228 |
| 3,517,601 | 6/1970 | Courchesne | 454/228 |

FOREIGN PATENT DOCUMENTS

| | | |
|---|---|---|
| 1800053 | 3/1943 | U.S.S.R. . |
| 478164 | 12/1975 | U.S.S.R. . |
| 713764 | 2/1980 | U.S.S.R. . |

*Primary Examiner*—Harold Joyce
*Attorney, Agent, or Firm*—Anthony R. Lambert

[57] ABSTRACT

A ventilator which includes a male member is telescopically received within a female housing. The male member is longer than the passage in the female housing such that the male member protrudes from the passage of the female housing. Radial air flow passages are positioned at both the first end and the second end of the male member. Relative movement of the male member and the female housing in a first direction diminishes the area of radial air flow passages exposed to air flow from the first end of the female housing while increasing the area of the radial air flow passages exposed to air flow from the second end of the female housing. Relative movement in a second direction diminishes the area of radial air flow passages exposed to air flow from the second end of the female housing while increasing the area of the radial air flow passages exposed to air flow from the first end of the female housing.

9 Claims, 5 Drawing Sheets

VENTILATOR

FIELD OF THE INVENTION

The present invention relates to a ventilator and, in particular, a ventilator used to draw fresh air into a building.

BACKGROUND OF THE INVENTION

Ventilators are used to draw fresh air into buildings. The volume of fresh air drawn in through a ventilator is the product of the area of the flow stream and the rate of flow; both of which variables can be controlled. The area of the flow steam can be controlled by means of a damper. The rate of flow can be controlled using a variable speed fan. These types of controls are inadequate, however, when there is a marked difference between the temperature of the fresh air and the temperature of the ambient air within the building. It is essential the volume of cold fresh air entering the building be controlled in order to maintain the building at a desired operating temperature. In order to reduce of the rate of flow of the colder fresh air, the fan is placed on its lowest speed setting. This, in and of itself, usually is inadequate. The damper is then moved to a closed or a substantially closed position. This virtually eliminates the circulation of fresh air into the building.

SUMMARY OF THE INVENTION

What is required is a ventilator which has means for controlling the flow of cold fresh air while maintaining reasonable circulation volumes.

According to the present invention there is provided a ventilator which includes a female housing having a first end, a second end, and a passage that extends through the female housing from the first end to the second end. A male member is telescopically received within the passage of the female housing. The male member is longer than the passage in the female housing such that the male member protrudes from the passage of the female housing. The male member has an air impermeable first end and an open second end in which is disposed a fan. At least one air flow channel extends between the first end and the fan at the second end of the male member. Radial air flow passages communicate with the at least one air flow channel at both the first end and the second end of the male member. Means is being provided to cause relative telescopic movement of the male member and the female housing. Relative movement in a first direction diminishes the area of the radial air flow passages exposed to air flow from the first end of the female housing while increasing the area of the radial air flow passages exposed to air flow from the second end of the female housing. Relative movement in a second direction diminishes the area of radial air flow passages exposed to air flow from the second end of the female housing while increasing the area of the radial air flow passages exposed to air flow from the first end of the female housing.

With the ventilator, as described above, fresh air is drawn from the first end of the female housing through the radial air flow passages and preheated air is drawn from the second end of the female housing through the radial air flow passages. By combining a stream of fresh air and preheated air, fresh air can continue to be introduced through the ventilator without diminishing the overall volume of circulating air. Mixing the fresh air with the preheated air makes the circulating air stream sufficiently temperate to prevent fluctuations in temperature within a building.

Although beneficial results may be obtained through the use of the ventilator, as described above, whenever fresh air in introduced into a room the cold air tends to fall, thereby creating a draft. Even more beneficial results may, therefore, be obtained when a diffuser is positioned at the open second end of the male member such that air exiting the male member past the fan is directed through the diffuser. The diffuser has a central cavity with a peripheral interior sidewall. Radial diffuser passages extend from the central cavity radially outwardly. A central cold air baffle is provided to direct cold air passing along the central cavity radially outwardly through the radial diffuser passages. A bottom warm air baffle being provided to direct warm air migrating down the peripheral interior sidewall radially outwardly through the radial diffuser passages, such that the warm air underlies the cold air.

With the diffuser configuration, as described, the problem of drafts is reduced, if not eliminated altogether. The reason for this is that preheated warm air tends to support the cold fresh air.

Although beneficial results may be obtained through the use of the ventilator as described, with or without the diffuser, manual control over the proportion of fresh air and preheated air is not always practical. Even more beneficial results may, therefore, be obtained when the means to cause relative telescopic movement of the male member and the female housing is coupled with temperature monitoring means. Relative telescopic movement of the male member and the female housing is actuated based upon temperature to adjust the proportion of air drawn from the radial air flow passages at the first end of the female housing and the radial air flow passages at the second end of the female housing. It is preferred that such control systems include a computer control which initiates an actuator to cause relative movement of the male member and the female housing. There are a wide variety of actuators and a wide variety of means that can be used to cause such relative movement, one of which will be hereinafter further described.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
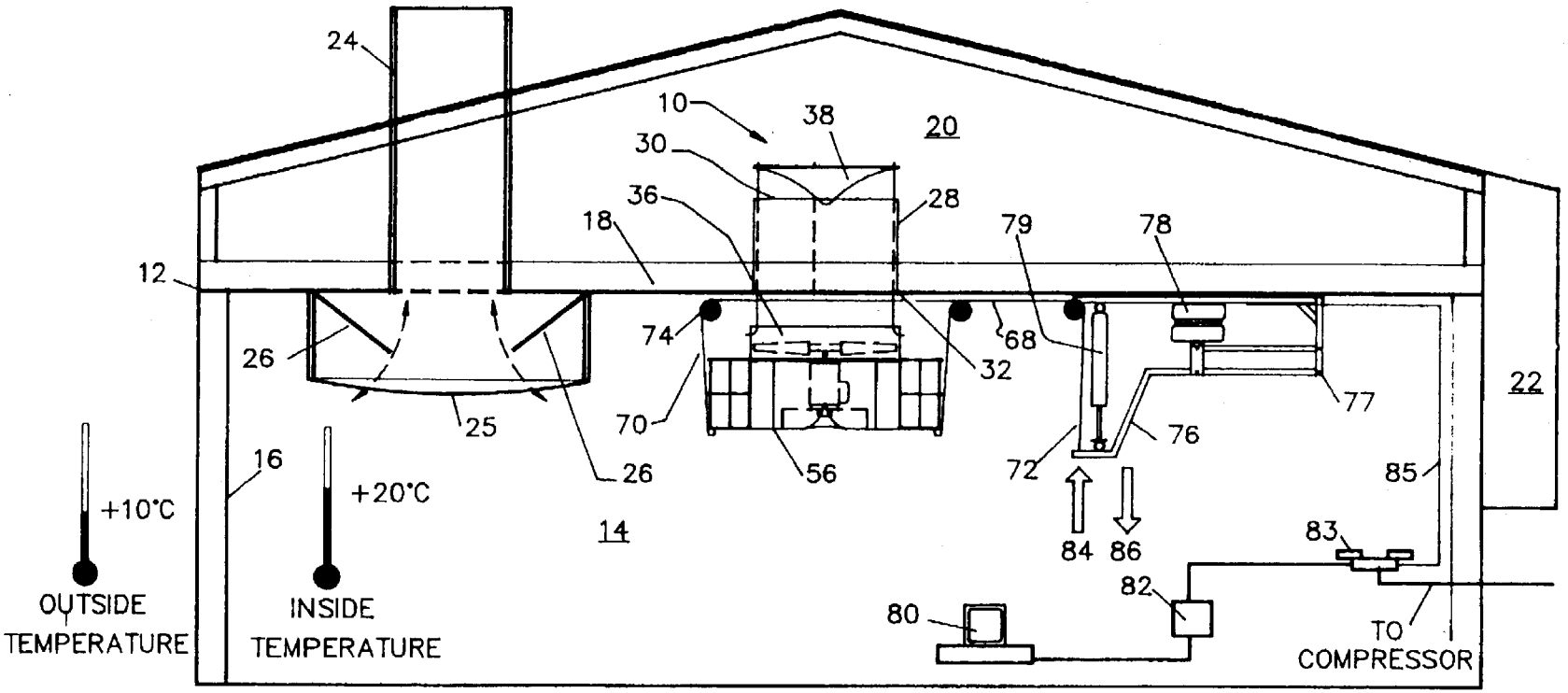
FIG. 1 is a side elevation view in section of a ventilator constructed in accordance with the teachings of the present invention installed in a building, with male member in a first telescopic position.

The preferred embodiment, a ventilator generally identified by reference numeral 10, will now be described with reference to FIGS. 1 through 6.

Figure 2:
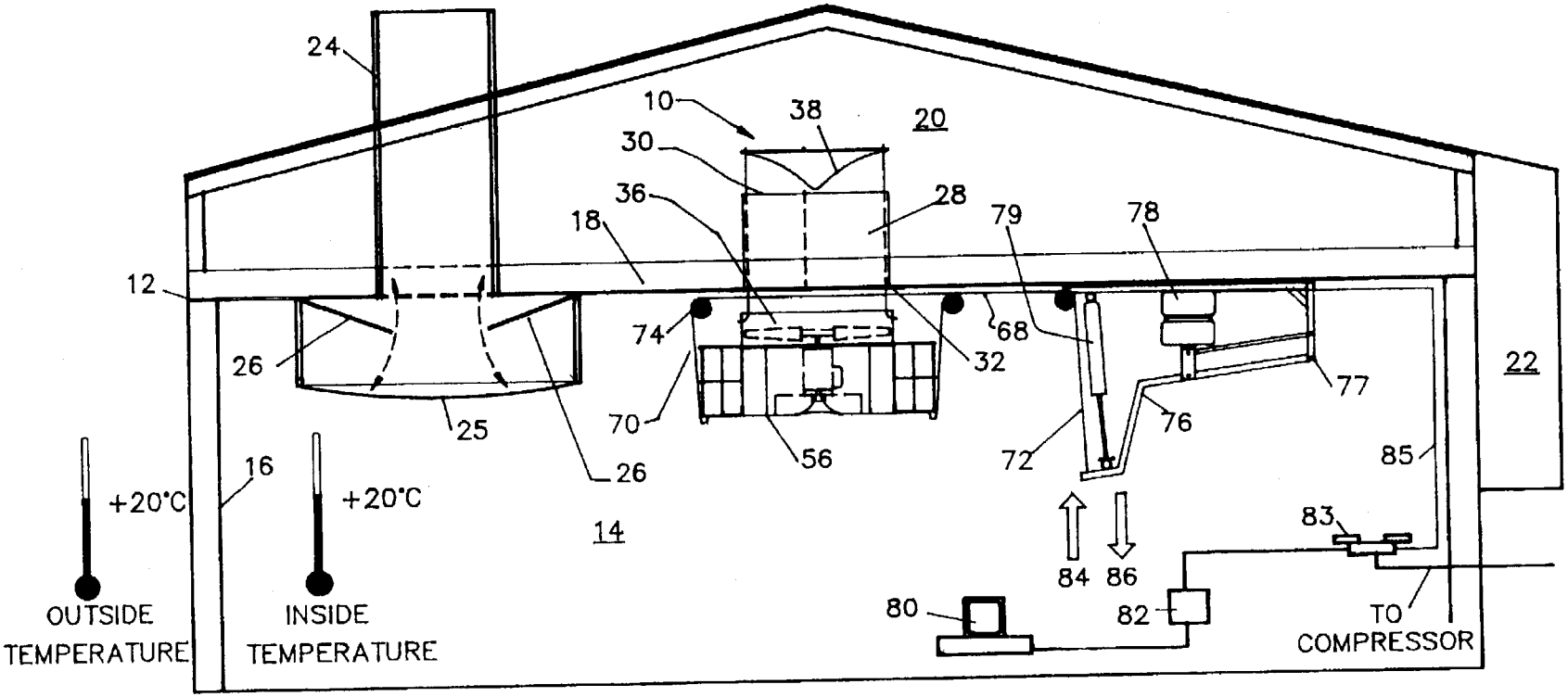
FIG. 2 is a side elevation view in section of a ventilator constructed in accordance with the teachings of the present invention installed in a building, with male member in a second telescopic position.

Referring to FIGS. 1 and 2, ventilator 10 is illustrated installed in a building 12. Building 12 has an interior space 14 which is to be ventilated. Interior space 14 is defined by enclosing sidewalls 16 and a ceiling 18. In this particular installation, an attic 20 is provided above ceiling 18 of interior space 14. Attic 20 is continuously supplied with fresh air through fresh air intake 22. Interior space 14 has an exhaust stack 24. Exhaust stack 24 has an underlying drip tray 25. One way air flaps 26 are positioned on either side of drip tray 25. One way air flaps 26 ensure that exhaust stack 24 serves as a means for preheated air to exit interior space 14 but precludes fresh air from entering.

Figure 3:
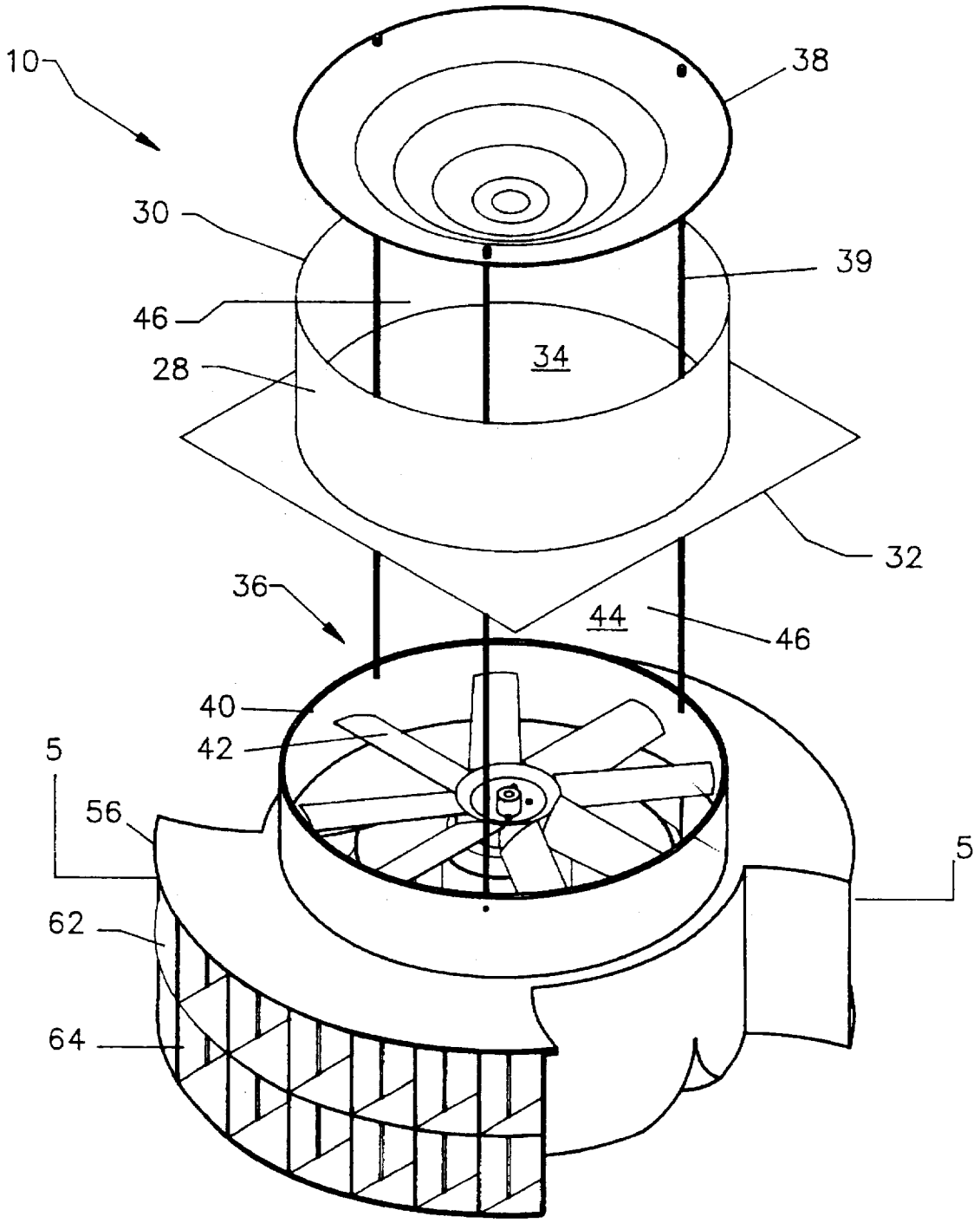
FIG. 3 is a perspective view of the ventilator illustrated in FIGS. 1 and 2.
Figure 4:
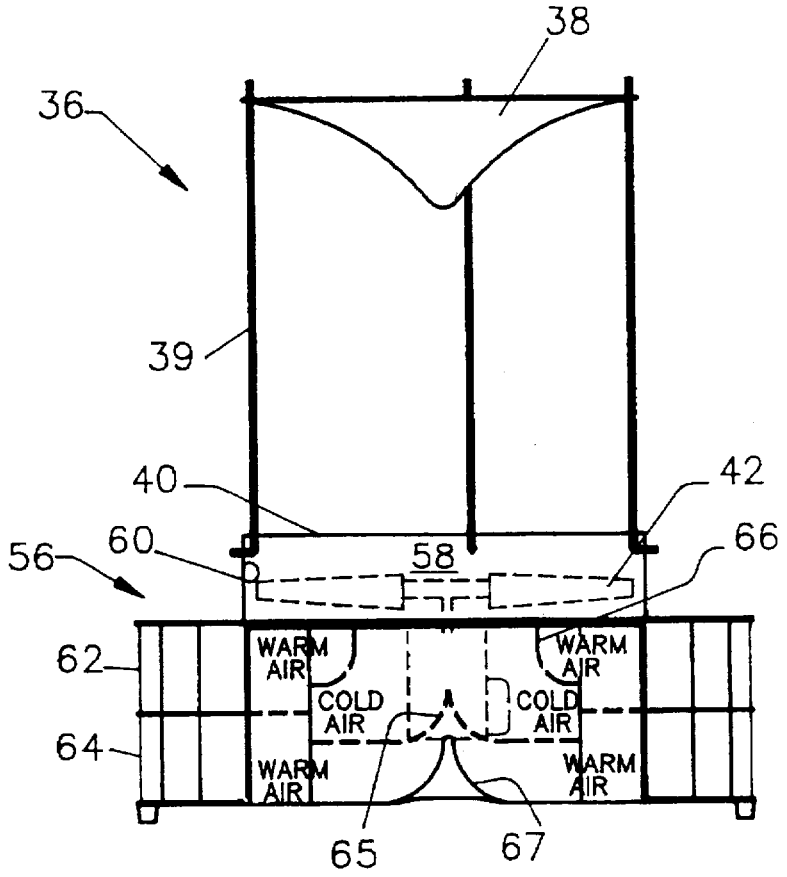
FIG. 4 is a side elevation view in section of the ventilator illustrated in FIG. 3.
Figure 5:
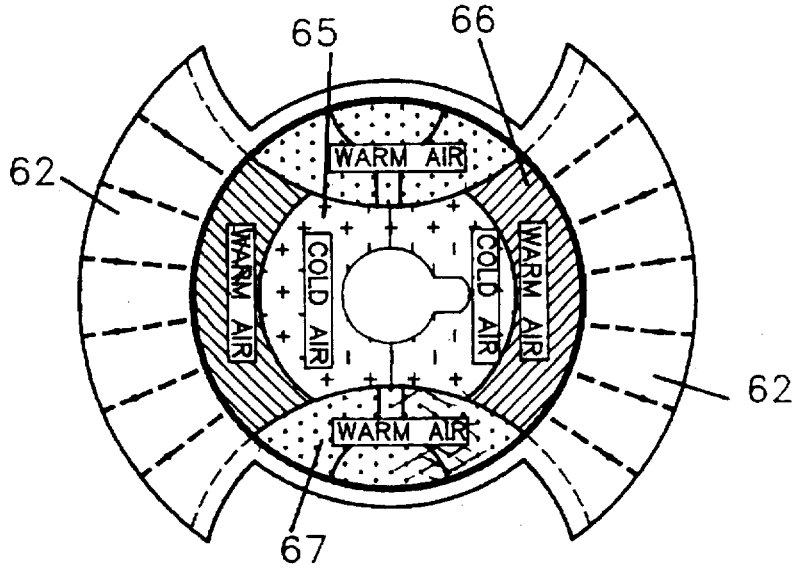
FIG. 5 is a top plan view in section of the ventilator illustrated in FIG. 3, taken along section lines 5—5.
Figure 6:
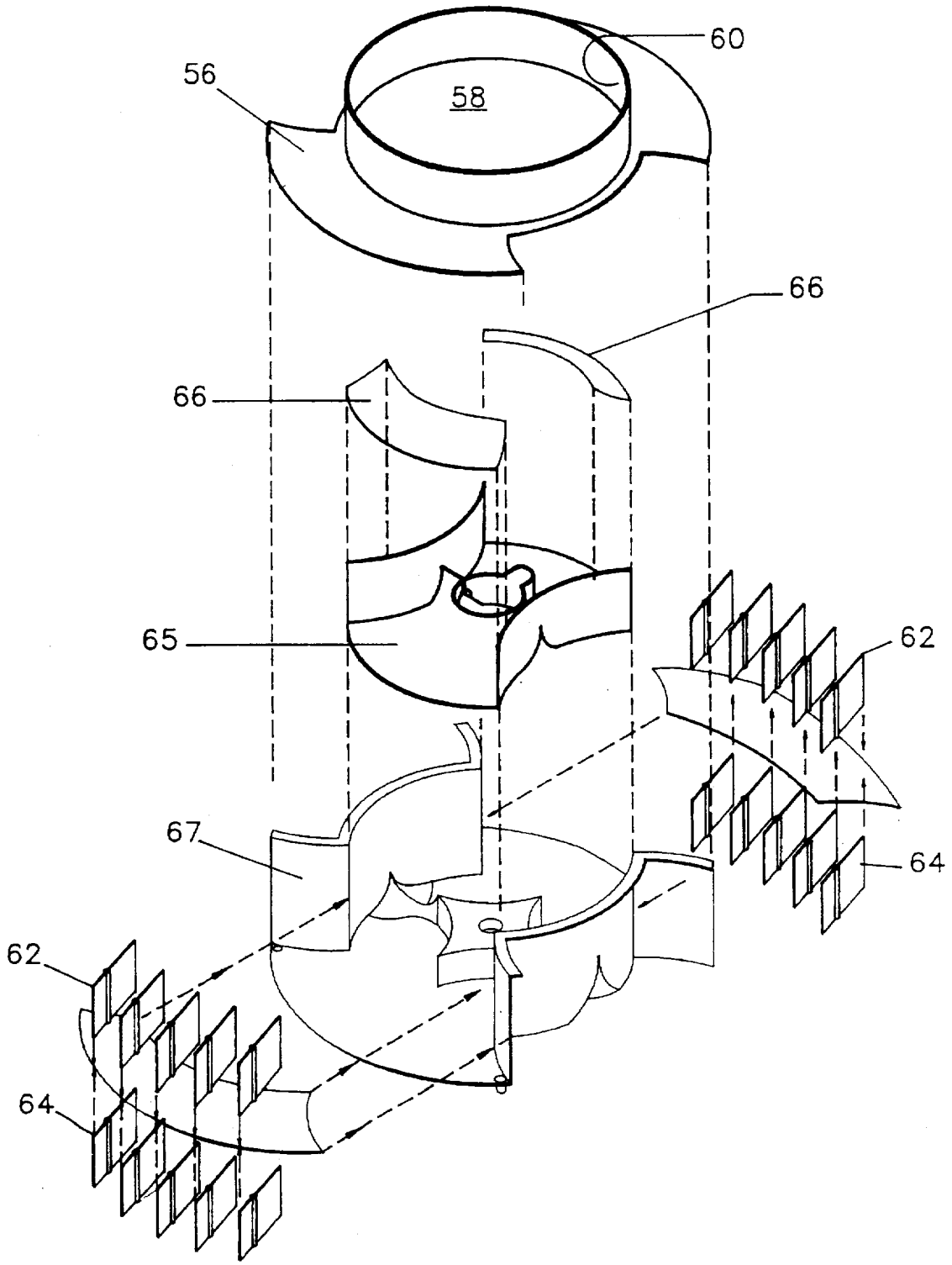
FIG. 6 is an exploded perspective view of a diffuser from the ventilator illustrated in FIG. 3.

Referring to FIG. 3, ventilator 10 includes a female housing 28 having a first end 30 and a second end 32. A passage 34 extends through female housing 28 from first end 30 to second end 32. Referring to FIGS. 1 and 2, female housing 28 is installed in building 12 in such a manner that female housing 28 extends through ceiling 18. When installed, as described, first end 30 is positioned in attic 20 where it is exposed to fresh air from fresh air intake 22 and second end 32 is positioned within interior space 14. Referring to FIG. 3, a male member 36 is telescopically received within passage 34 of female housing 28. Male member 36 is longer than passage 34 such that male member 36 protrudes from passage 34 of female housing 28 at first end 30, second end 32 or both. Male member 36 has a first end 38 connected by a plurality of support rods 39 to a second end 40. First end 38 is air impermeable. Second end 40 is open. A variable speed fan 42 is disposed within open second end 40. A central air flow channel 44 extends between first end 38 and second end 40 of male member 36. Spaces between support rods 39 provide a plurality of radial air flow passages 46 that communicate with central air flow channel 44 at both first end 38 and second end 40 of male member 36. Male member 36 includes a diffuser 56 which is attached to open second end 40. All air exiting male member 36 past fan 42 is directed through diffuser 56. Referring to FIG. 4, diffuser 56 has a central cavity 58 with a peripheral interior sidewall 60. An upper row of radial diffuser passages 62 are provided that communicate with central cavity 58. A lower row of radial diffuser passages 64 are provided which also communicate with central cavity 58. Referring to FIG. 6, the internal structure of diffuser 56 includes a central cold air baffle 65 which directs cold air passing along central cavity 58 radially outwardly through both upper row 62 and lower row 64 of radial diffuser passages. A pair of top warm air baffles 66 are spaced from peripheral interior sidewall 60 on two sides to direct warm air migrating down peripheral interior sidewall 60 radially outwardly through upper row 62 of radial diffuser passages. A bottom warm air baffle 67 is provided to direct warm air migrating down the other two sides of peripheral interior sidewall 60 radially outwardly through lower row 64 of radial diffuser passages. Referring to FIG. 5, cold air which strikes central cold air baffle 65 exits upper row 62 and lower row 64 of radial diffuser passages and is sandwiched between overlying warm air deflected by top warm air baffle 66 which exits through upper row 62 of radial diffuser passages and underlying warm air deflected by bottom warm air baffle 67 which exits lower row 64 of radial diffuser passages. Referring to FIGS. 1 and 2, a cable 68 is provided having a first end 70 and a second end 72. First end 70 is secured through a series of pulleys 74 to male member 36. Second end 72 is secured to an arm 76 which is mounted to ceiling 18 and pivots about pivot point 77. An pneumatic actuator 78 is secured to arm 76. Actuator 78 is designed to impart pivotal movement to arm 76. A telescopic hydraulic dampener 79 is provided to provide resistance to movement of arm 76. A computer 80 is linked with both a temperature sensor 82 and via an electric air valve 83 and an air line 85 to pneumatic actuator 78. Electric air valve 83 is connected to a source of pressurized air in the form of an air compressor (not shown).

The use and operation of ventilator 10 will now be described with reference to FIGS. 1 through 6. Computer 80 is programmed to maintain interior space 14 at a preset temperature, such as 70 degrees fahrenheit. Computer 80 receives input from temperature sensor 82 as to what the actual temperature is in interior space 14. Computer 80 then opens electric air valve 83 to send air through air line 85 to pneumatic actuator 78, or conversely draw air from pneumatic actuator 78. Pneumatic actuator 78 expands or contracts and in doing so moves pivotally mounted arm 76 in one of a first direction, as indicated by arrow 84, or a second direction, as indicated by arrow 86. Movement of arm 76 initiates telescopic movement of male member 36 relative to female housing 28 to adjust the proportion of air drawn from radial air flow passages 46 at first end 38 and second end 40 of male member 36 as may be required to maintain the temperature at 70 degrees. Referring to FIG. 1, when pneumatic actuator 78 contracts arm 76 moves in first direction 84 creating slack in cable 68 and thereby lowering male member 36 relative to female housing 28. The lowering of male member 36 relative to female housing 28 diminishes the area at first end 30 of female housing 28 through which fresh air from attic 20 may be drawn and increases the area at second end 32 of female housing 28 exposed to a flow of preheated air from within interior space 14 of building 12. Referring to FIG. 2, the expansion of pneumatic actuator 78 pivots arm 76 in second direction 86 exerts a pulling force upon cable 68 thereby raising male member 36 relative to female housing 28. The raising of male member 36 relative to female housing 28 has the converse effect. It diminishes the area at second end 32 of female housing 28 through which preheated air may be drawn and increases the area at first end 30 of female housing 28 through which fresh air may be drawn. Cold fresh air and warmer preheated air pass through radial air flow passages 46 is varying proportions in central air flow channel 44. As described above, the proportion of cold fresh air and warmer preheated air is dependent upon the positioning of male member 36. Referring to FIGS. 4 and 5, the air streams follow different flow paths through diffuser 56. Cold air strikes central cold air baffle 65 causing it to exit through both upper row 62 and lower row 64 of radial diffuser passages. A portion of the warm air is deflected by top warm air baffle 66 and exits through upper row 62 of radial diffuser passages overlying the cold air. The remainder of the warm air is deflected by bottom warm air baffle 67 and exits lower row 64 of radial diffuser passages underlying the cold air.

It will be apparent to one skilled in the art that the ventilator, as described above, allows the inflow of cold fresh air to be tempered with a flow of preheated air drawn from interior space 14. In accordance with this teaching, the volume of air circulated can be kept substantially constant and the proportion of cold fresh air modified as required. In order to reduce drafts, diffuser 56 is employed to support the cold fresh air aloft on a stream of rising preheated air. A control system can be added to automatically modify the proportion of fresh air passing through the ventilator, as conditions change. Ventilator 10, as described mixes cold air entering the building with warm air from the building. The flow rate is controlled by fan speed and the proportions of inside and outside air are controlled by moving male member 36, as described above. It will finally be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A ventilator, comprising:

a female housing having a first end, a second end, and a passage that extends through the female housing from the first end to the second end, said female housing having an axis disposed vertically;

a skeletal male member telescopically received within the passage of the female housing, the male member being longer then the passage in the female housing such that the male member protrudes from the passage of the female housing, the male member having an air impermeable first end and an open second end in which is disposed a fan, the first end and the second end being connected by support rods, at least one air flow channel extends between the first end and the fan at the second end of the male member, radial air flow passages communicate with the at least one air flow channel at both the first end and the second end of the male member; and means being provided to cause relative telescopic movement of the male member and the female housing, such that relative movement in a first direction diminishes the area of radial air flow passages exposed to air flow from the first end of the female housing while increasing the area of the radial air flow passages exposed to air flow from the second end of the female housing, and relative movement in a second direction diminishes the area of radial air flow passages exposed to air flow from the second end of the female housing while increasing the area of radial air flow passages exposed to air flow from the first end of the female housing;

the female housing being stationary and the male member being telescopically movable relative to the female housing, gravity serving as the means to cause telescopic movement of the male member in one direction.

2. The ventilator as defined in claim 1, wherein the female housing is stationary and the male member is telescopically movable relative to the female housing, the means to cause telescopic movement of the male member being a cable, a first end of which is secured through a series of pulleys to the male member and a second end of which is secured to a pivotally mounted arm, an actuator being secured to the arm and being in data communication with the computer, such that upon a signal being received from the computer the actuator pivots the pivotally mounted arm in one of a first direction and a second direction, the alteration of the pivotal position of the arm in the first direction causing slack in the cable thereby causing the male member to move in the first direction relative to the female housing, the alteration of the pivotal position of the arm in the second direction exerting a pulling force upon the cable thereby causing the male member to move in the second direction relative to the female housing.

3. A ventilator, comprising:

a female housing having a first end, a second end, and a passage that extends through the female housing from the first end to the second end;

a male member telescopically received within the passage of the female housing, the male member being longer than the passage in the female housing such that the male member protrudes from the passage of the female housing, the male member having an air impermeable first end and an open second end in which is disposed a fan, at least one air flow channel extends between the first end and the fan at the second end of the male member, radial air flow passages communicate with the at least one air flow channel at both the first end and the second end of the male member; and means being provided to cause relative telescopic movement of the male member and the female housing, such that relative movement in a first direction diminishes the area of radial air flow passages exposed to air flow from the first end of the female housing while increasing the area of the radial air flow passages exposed to air flow from the second end of the female housing, and relative movement in a second direction diminishes the area of radial air flow passages exposed to air flow from the second end of the female housing while increasing the area of radial air flow passages exposed to air flow from the first end of the female housing; and, a diffuser positioned at the open second end of the male member such that air exiting the male member past the fan is directed through the diffuser, the diffuser having a central cavity with a peripheral interior sidewall, and radial diffuser passages extending from the central cavity radially outwardly, a central cold air baffle being provided to direct cold air passing along the central cavity radially outwardly through the radial diffuser passages, a bottom warm air baffle being provided to direct warm air migrating down the peripheral interior sidewall radially outwardly through the radial diffuser passages such that the warm air underlies the cold air.

4. The ventilator as defined in claim 3, wherein the means to cause relative telescopic movement of the male member and the female housing is coupled with temperature monitoring means, such that relative telescopic movement of the male member and the female housing is actuated based upon temperature to adjust the proportion of air drawn from radial air flow passages at the first end and the second end of the male member.

5. A ventilator, comprising:

a female housing having a first end, a second end, and a passage that extends through the female housing from the first end to the second end;

a male member telescopically received within the passage of the female housing, the male member being longer than the passage in the female housing such that the male member protrudes from the passage of the female housing, the male member having an air impermeable first end and an open second end in which is disposed a fan, at least one air flow channel extends from the first end and the fan at the second end of the male member, radial air flow passages communicate with the at least one air flow channel at both the first end and the second end of the male member; and means being provided to cause relative telescopic movement of the male member and the female housing, such that relative movement in a first direction diminishes the area of radial air flow passages exposed to air flow from the first end of the female housing while increasing the area of the radial air flow passages exposed to air flow from the second end of the female housing, and relative movement in a second direction diminishes the area of radial air flow passages exposed to air flow from the second end of the female housing while increasing the area of radial air flow passage exposed to air flow from the first end of the female housing; and the female housing being stationary and the male member being telescopically movable relative to the female housing, the means to cause telescopic movement of the male member being a cable, a first end of which is secured through a series of pulleys to the male member and a second end of which is secured to means for lengthening and shortening the cable.

6. The ventilator as defined in claim 5, wherein the second end of the cable is secured to a pivotally mounted arm, the means for lengthening and shortening the cable being to pivot the pivotally mounted arm, an actuator being provided to alter the pivotal position of the arm.

7. A ventilator, comprising:

a female housing having a first end, a second end, and a passage that extends through the female housing from the first end to the second end;

a male member telescopically received within the passage of the female housing, the male member being longer than the passage in the female housing such that the male member protrudes from the passage of the female housing, the male member having an air impermeable first end and an open second end in which is disposed a fan, an air flow channel extends between the first end and the fan at the second end of the male member, radial air flow passages communicate with the air flow channel at both the first end and the second end of the male member;

a diffuser being positioned at the open second end of the male member such that air exiting the male member past the fan is directed through the diffuser, the diffuser having a central cavity with a peripheral interior sidewall, and an upper row and a lower row of radial diffuser passages extending from the central cavity radially outwardly, a central cold air baffle being provided to direct cold air passing along the central cavity radially outwardly through the upper row and the lower row of radial diffuser passages, a top warm air baffle being provided to direct warm air migrating down the peripheral interior sidewall radially outwardly through the upper row of radial diffuser passages, a bottom warm air baffle being provided to direct warm air migrating down the peripheral interior sidewall radially outwardly through the lower row of radial diffuser passages such that the cold air exiting the upper row and the lower row of radial diffuser passages is sandwiched between overlying warm air exiting the upper row of radial diffuser passages and underlying air exiting the lower row of radial diffuser passages;

means being provided to cause relative telescopic movement of the male member and the female housing, such that relative movement in a first direction diminishes the area of radial air flow passages exposed to air flow from the first end of the female housing while increasing the area of radial air flow passages exposed to air flow from the second end of the female housing, and relative movement in a second direction diminishes the area of radial air flow passages exposed to air flow from the second end of the female housing while increasing the area of radial air flow passages exposed to air flow from the first end of the female housing; and means to cause relative telescopic movement of the male member and the female housing being coupled to a computer linked with a temperature sensor and programmed to maintain a preset temperature, the computer receiving input from the temperature sensor and initiating relative telescopic movement of the male member and the female housing to adjust the proportion of air drawn from first end and second end of the female housing as may be required to maintain the preset temperature.

8. In combination:

a building having an interior space with enclosing sidewalls and a ceiling;

a ventilator, comprising:

a female housing having a first end, a second end, and a passage that extends through the female housing from the first end to the second end, the female housing extending through the ceiling of the building with the first end positioned adjacent a source of fresh air and the second end positioned within the interior space;

a male member telescopically received within the passage of the female housing, the male member being longer than the passage in the female housing such that the male member protrudes from the passage of the female housing, the male member having an air impermeable first end and an open second end in which is disposed a fan, an air flow channel extends between the first end and the fan at the second end of the male member, radial air flow passages communicate with the air flow channel at both the first end and the second end of the male member;

a diffuser being positioned at the open second end of the male member such that air exiting the male member past the fan is directed through the diffuser, the diffuser having a central cavity with a peripheral interior sidewall, and an upper row and a lower row of radial diffuser passages extending from the central cavity radially outwardly, a central cold air baffle being provided to direct cold air passing along the central cavity radially outwardly through the upper row and the lower row of radial diffuser passages, a top warm air baffle being provided to direct warm air migrating down the peripheral interior sidewall radially outwardly through the upper row of radial diffuser passages, a bottom warm air baffle being provided to direct warm air migrating down the peripheral interior sidewall radially outwardly through the lower row of radial diffuser passages such that the cold air exiting the upper row and the lower row of radial diffuser passages is sandwiched between overlying warm air exiting the upper row of radial diffuser passages and underlying air exiting the lower row of radial diffuser passages;

a cable having a first end and a second end, the first end being secured through a series of pulleys to the male member and the second end being secured to a pivotally mounted arm;

an actuator being secured to the arm;

a computer being linked with a temperature sensor and the actuator, the computer being programmed to maintain a preset temperature, the computer receiving input from the temperature sensor and initiating relative telescopic movement of the male member and the female housing to adjust the proportion of air drawn through the radial air flow passages at the first end and the second end of the female housing as may be required to maintain the preset temperature, upon a signal being received from the computer the actuator pivots the pivotally mounted arm in one of a first direction and a second direction, the alteration of the pivotal position of the arm in the first direction causing slack in the cable thereby lowering the male member relative to the female housing, the lowering of the male member relative to the female housing diminishes the area of the radial air flow passages through which fresh air is drawn from the first end of the female housing positioned adjacent the source of fresh air, while increasing the area of the radial air flow passages through which preheated air is drawn from the second end of the female housing positioned within the interior space of the building, the alteration of the pivotal position of the arm in the second direction exerting a pulling force upon the cable thereby raising the male member relative to the female housing, the raising of the male member relative to the female housing diminishes the area of the radial air flow passages through which preheated air is drawn from the second end of the female housing positioned within the interior space of the building, while increasing the area of the radial air flow passages through which fresh air is drawn from the first end of the female housing positioned adjacent to the source of fresh air, cold fresh air drawn from the first end of the female housing passing along the central cavity until it strikes the central cold air baffle which directs such cold air radially outwardly through the upper row and the lower row of radial diffuser passages, warm air migrating down the peripheral interior sidewall strikes one of the top warm air baffle and the bottom warm air baffle which directs such warm air radially outwardly through the upper row and the lower row of radial diffuser passages, respectively, such that the cold air exiting the upper row and the lower row of radial diffuser passages is sandwiched between overlying warm air exiting the upper row of radial diffuser passages and underlying air exiting the lower row of radial diffuser passages.

9. In combination:

a building having defining walls and a roof/ceiling structure;

a ventilator, comprising:

a female housing having a first end, a second end, and a passage that extends through the female housing from the first end to the second end, the female housing being vertically secured within the roof/ceiling structure;

a male member telescopically received within the passage of the female housing, the male member being longer than the passage in the female housing such that the male member protrudes from the passage of the female housing, the male member having an air impermeable first end and an open second end in which is disposed a fan, at least one air flow channel extends between the first end and the fan at the second end of the male member, radial air flow passages communicate with the at least one air flow channel at both the first end and the second end of the male member;

a cable having a first end secured through a series of pulleys to the male member and a second end secured to means for lengthening and shortening the cable to raise and lower the male member relative to the female housing, a controlled lowering of the male member by cable assisted by force of gravity diminishes the area of radial air flow passages exposed to air flow from the first end of the female housing while increasing the area of the radial air flow passage exposed to air flow from the second end of the female housing, and raising the male member by cable diminishes the area of radial air flow passages exposed to air flow from the second end of the female housing while increasing the area of radial air flow passages exposed to air flow from the first end of the female housing.

* * * * *